US005232226A

United States Patent [19]

Glickson

[11] Patent Number: 5,232,226

[45] Date of Patent: Aug. 3, 1993

[54] APPARATUS AND METHOD FOR PROPELLING AND RETRIEVING A DISK

[75] Inventor: David A. Glickson, Chicago, Ill.

[73] Assignee: Rapid Mounting and Finishing Co.-Cadaco Division, Chicago, Ill.

[21] Appl. No.: 924,108

[22] Filed: Aug. 3, 1992

[51] Int. Cl.[5] ..... A63B 67/06; A63B 65/10

[52] U.S. Cl. ..... 273/323; 124/5; 273/326

[58] Field of Search ..... 273/326, 323, 322; 124/5

[56] References Cited

U.S. PATENT DOCUMENTS

| | | | |
|---|---|---|---|
| 708,519 | 9/1902 | Bradshaw . | |
| 1,022,186 | 4/1912 | Engler . | |
| 1,186,098 | 6/1916 | Horst . | |
| 1,306,381 | 6/1919 | Johnson | 124/5 |
| 1,306,393 | 6/1919 | Sibley | 124/5 |
| 2,097,652 | 11/1937 | Vater . | |
| 2,124,738 | 7/1938 | Johnsen . | |
| 2,126,628 | 8/1938 | Fiondella . | |
| 2,321,371 | 6/1943 | Du Pont . | |
| 2,493,245 | 1/1950 | Hansen . | |
| 2,586,547 | 2/1952 | Marley . | |
| 2,690,339 | 9/1954 | Hall | 124/5 X |
| 2,996,058 | 8/1961 | Ervine . | |
| 2,997,039 | 8/1961 | Fehn | 124/5 |
| 3,061,311 | 10/1962 | Von Arnhem | 273/323 |
| 3,185,479 | 5/1965 | Ortega . | |
| 3,359,678 | 12/1967 | Headrick . | |
| 3,464,155 | 9/1969 | Capalia et al. . | |
| 3,594,945 | 7/1971 | Turney . | |
| 3,610,916 | 10/1971 | Meehan . | |
| 3,618,585 | 11/1971 | Allison . | |
| 3,711,096 | 1/1973 | Cramp et al. . | |
| 3,717,136 | 2/1973 | Gay et al. . | |
| 3,765,122 | 10/1973 | English . | |
| 3,786,246 | 1/1974 | Johnson et al. . | |
| 3,812,614 | 5/1974 | Harrington . | |
| 3,828,466 | 8/1974 | Geiger . | |
| 3,900,986 | 8/1975 | Torres . | |
| 3,900,987 | 8/1975 | Holt . | |
| 3,959,916 | 6/1976 | Meyer . | |
| 4,031,655 | 6/1977 | Ponciano et al. . | |
| 4,045,027 | 8/1977 | Manska.. | |
| 4,063,382 | 12/1977 | McCallum . | |
| 4,076,004 | 2/1978 | Huelskamp . | |
| 4,117,626 | 10/1978 | Kifferstein et al. . | |
| 4,132,031 | 1/1979 | Psyras . | |
| 4,145,050 | 3/1979 | Sullivan et al. . | |
| 4,157,828 | 6/1979 | Cosmopulos | 273/323 |
| 4,277,068 | 7/1981 | Sasaki . | |
| 4,307,538 | 12/1981 | Moffitt . | |
| 4,383,244 | 5/1983 | Knauff . | |
| 4,560,358 | 12/1985 | Adler . | |
| 4,563,160 | 1/1986 | Lee . | |
| 4,730,595 | 3/1988 | Glass et al. . | |
| 4,752,076 | 6/1988 | Gelinas, Jr. . | |
| 4,778,428 | 10/1988 | Wield . | |
| 4,819,947 | 4/1989 | Mackey . | |
| 4,872,688 | 10/1989 | Galvin | 273/326 |
| 4,980,110 | 12/1990 | Nelson et al. . | |
| 5,032,098 | 7/1991 | Balogh et al. . | |
| 5,083,799 | 1/1992 | Thill . | |

FOREIGN PATENT DOCUMENTS

| | | |
|---|---|---|
| 661779 | 6/1938 | Fed. Rep. of Germany . |
| 753192 | 10/1933 | France . |
| 591257 | 9/1947 | United Kingdom . |

*Primary Examiner*—Paul E. Shapiro

[57] ABSTRACT

A method and apparatus for propelling and retrieving an aerodynamic flying disk. The apparatus includes a lower support member used to support the flying disk. The lower support member is hingedly coupled to an upper support member, and the two support members form a cavity to retain the disk. A handle is also provided on the lower support member, opposite an open end of the cavity, to allow a user to grasp the apparatus. A disk is inserted within the apparatus, propelled by a player out through an aperture at the opposite end of the cavity from a handle, and retrieved by opening and closing upper and lower support members to retain the disk.

19 Claims, 2 Drawing Sheets

APPARATUS AND METHOD FOR PROPELLING AND RETRIEVING A DISK

FIELD OF THE INVENTION

The present invention relates to a launching and catching apparatus and game for use with aerodynamic flying disks.

BACKGROUND OF THE INVENTION

For many years, children and adults alike have found amusement and have passed the time by playing with aerodynamic flying disks. One popular version of such disk is marketed under the trade name "FRISBEE" and distributed by WHAM-O Manufacturing Co., a Kransco Group Company, of San Francisco, Calif. The object of the game, played in its traditional fashion, is to toss a disk back and forth between two or more players. The disk can be thrown with accuracy by imparting a circular spin on the disk by using a wrist-snapping or whipping motion.

In the above-described game, the person catching the disk can do so in a variety of ways. A player can simply catch the disk while it is in the air by grabbing the disk at its periphery and thus stopping its spinning motion. Some more advanced players, however, have developed various intricate and acrobatic ways of catching the disk involving many stunts and tricks to ultimately bring the disk to rest in one's hands.

More elaborate games have also been devised employing the aerodynamic flying disk. One example includes a game called "ultimate frisbee" that combines some of the features of European soccer and English rugby while using the flying disk. The aerodynamic flying disk can also be played solo employing some of the acrobatic acts referred to above in connection with catching the disk.

One problem with playing with the popular aerodynamic disk has been the player's ability to propel and catch the disk properly. For those who have difficulty developing the wrist-snapping motion required to accurately and properly throw the disk, the above games become hard, if not impossible, to play. In addition, there is a risk of injury to the hands and fingers if the disk is not caught properly. Moreover, for those who lack sufficient hand/arm strength, it is difficult to propel the flying disk more than a short distance, even when thrown using the proper technique.

Attempts have been made to provide an apparatus to assist in playing with an aerodynamic flying disk, but such attempts suffer from their own deficiencies. For example, U.S. Pat. No. 4,157,828, discloses a hand-held disk launching and catching device. However, the device disclosed is large and cumbersome, and may be difficult to manipulate to catch and retain the flying disk. Another example, U.S. Pat. No. 4,872,688, also discloses a hand-held disk launching and catching apparatus. However, this patent may also be difficult to use to catch and retain the flying disk.

What is lacking, therefore, is a device that can be used to easily catch and retain the disk. A device of this type would be easy to use and would allow those who are young or are unable to properly manipulate the flying disk to catch and propel the disk. Such a device would preferably be light in weight and provide a facility to easily locate and catch the disk. The device would also preferably assist the player in throwing the disk using the same wrist-snapping motion employed to propel the disk by hand.

SUMMARY OF THE INVENTION

In view of the above, it is an object of the invention to provide a hand-held disk propelling and retrieving apparatus to be employed to throw and retrieve an aerodynamic flying disk.

It is also an object of the invention to provide a device that is both light in weight and easy to use, and allows those unable to throw and catch the disk to do so with relative ease.

It is a further object of the invention to provide an apparatus of a size that fits easily in a player's hand to propel disks that are approximately six to nine inches in diameter.

According to the invention, a disk propelling and retrieving apparatus is provided, which includes a lower support member. Also provided is an upper support member that is hingedly coupled to the lower support member. A handle is disposed on the lower support member so that a player can use the device. The upper and lower support members together form a cavity having a width sized to receive the disk and having an open end opposite the handle.

In another aspect of the invention, a method is provided for propelling and retrieving a disk including the step of inserting the disk within a cavity defined by upper and lower support members joined together by a hinge. The cavity is preferably of sufficient size to retain and hold the disk. The disk is then propelled by a player using a wrist-snapping or whipping motion from within the cavity through an aperture disposed at one end of the cavity so as to fly through the air. The disk is finally retrieved by raising the upper support member about the hinge from its resting position in contact with the lower support member. The upper support member is then lowered to retain the disk either within the cavity or between both support members. In a preferred embodiment of the invention, two or more players employing the above steps can practice the invention to play a game.

The game device described below provides significant advantages over the prior art and allows a player to propel and retrieve an aerodynamic flying disk easily. The upper and lower support members, which are hingedly connected and preferably define a disk retaining cavity, make it easy to catch and retrieve the disk as it flies through the air. The upper and lower support members are preferably controlled by the player's thumb and index finger and are thus easily manipulated. The apparatus of the invention has the additional advantage of protecting the hands and fingers of those playing with the disk from injury, thereby making the apparatus attractive for use by children. The apparatus is also of a sufficient size to impart the necessary spin to the disk as it is propelled from the cavity to travel through the air for long distances.

Once the disk is placed or caught within the cavity it can be easily propelled out from the open end of the cavity using a wrist-snapping motion similar to that employed to throw the disk without the aid of any apparatus. As a result, by using the device described below, a player can learn the proper motion to propel a disk by hand.

These and other features and advantages of the invention will be further understood upon consideration of the following detailed description of the presently preferred embodiments of the invention, taken in conjunction with the appended drawings.

DETAILED DESCRIPTION OF THE PRESENTLY PREFERRED EMBODIMENTS

Figure 1:
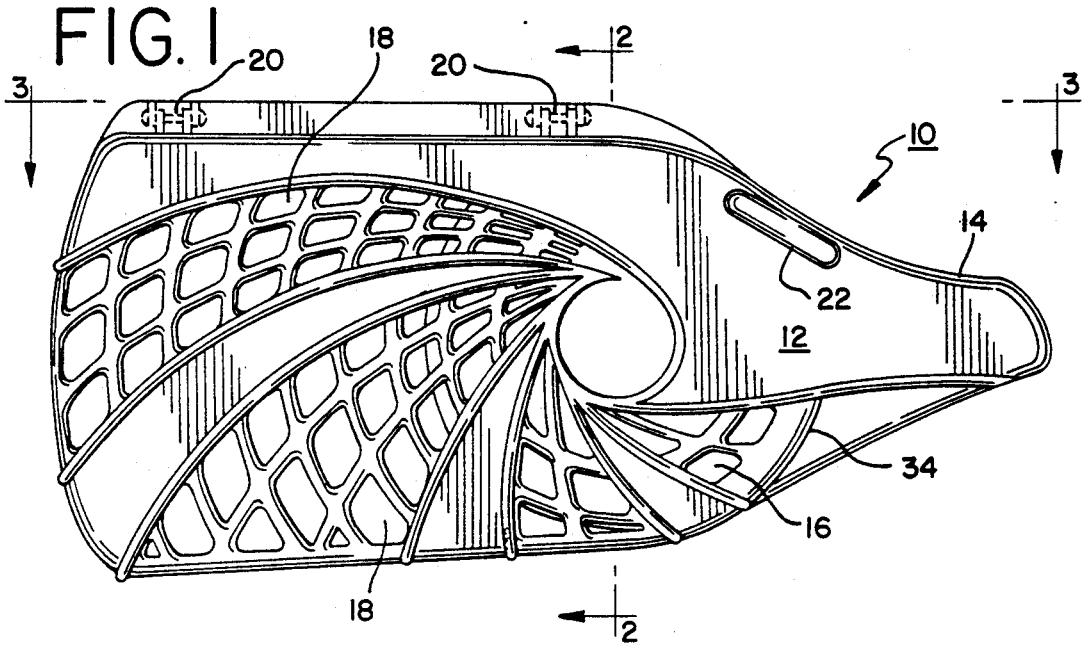
FIG. 1 is a top plan view of a preferred embodiment of a disk propelling and retrieving apparatus made according to the invention.

Referring now to the drawings, where like numerals refer to like elements throughout, FIG. 1 shows one presently preferred embodiment of a disk propelling and retrieving apparatus 10 made according to the invention. In the top plan view of FIG. 1, a substantially flat, upper support member 12 of the disk propelling and retrieving apparatus 10 is illustrated. Also shown in FIG. 1 is a handle section 14, which, in the preferred embodiment, is configured to and is a part of, both the upper support member 12 and a lower support member (described below).

FIG. 1 also shows an aerodynamic flying disk 16 positioned immediately beneath the upper support member 12. The aerodynamic flying disk 16 can be seen through the upper support member 12 due to the plurality of stylistic apertures 18 preferably included in the upper (and also lower) support member 12. The apertures 18 result in a significant weight reduction for the disk propelling and retrieving apparatus 10, which makes the device easy to handle and operate. The aerodynamic flying disk 16 is shown retained within a cavity located between the upper and lower support members, which will be described in more detail below in connection with FIG. 2.

FIG. 1 also shows in phantom lines the presently preferred mechanical hinges 20 that connect the upper support member 12 to the lower support member. The hinges 20 allow both support members to pivot about an axis intersecting the hinges 20 as the support members are used by a player. In the presently preferred embodiment of the invention, the player would employ one or more finger loops 22 included on both support members to cause the support members to pivot about the axis.

Figure 2:
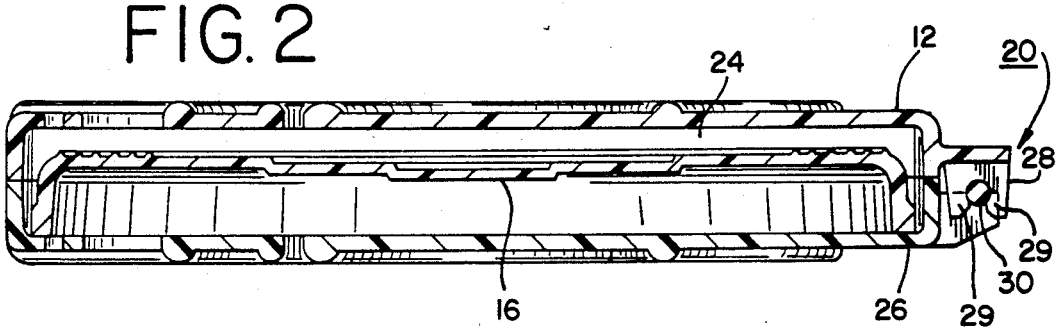
FIG. 2 is a cross-sectional view taken along line 2—2 of FIG. 1 showing the cavity of the apparatus and containing a disk.

FIG. 2 is a cross-sectional view that shows the cavity 24 between the upper support member 12 and lower support member 26. The aerodynamic flying disk 16 is retained within the cavity 24. As can be seen, the upper support member 12 and lower support member 26 are configured to define the cavity 24, which should be of sufficient width to accept and contain the aerodynamic flying disk 16. In the preferred embodiment, the disk 16 fits flush against a back retaining wall 34 of the cavity 24 (see also FIG. 4), which has a radius of curvature along most of its length matching that of the disk 16.

FIG. 2 also shows a side view of one of the presently preferred mechanical hinges 20. In the preferred embodiment, the hinges 20 comprise a snap-fit assembly where the upper support member 12 includes a clamp portion 28 of the hinge 20, and the lower support member 26 includes a dowel rod 30. The clamp portion 28 of the hinge 20 further includes opposing arms 29 that snap around and hold the dowel rod 30. As described in detail below, the disk propelling and retrieving apparatus 10 is preferably manufactured from materials that permit minor separation of the opposing arms 29 to accept the dowel rod 30. The clamp 28 thus snaps over the dowel rod 30 when the upper and lower support members 12, 26 are pressed together upon assembly.

In this manner, the hinges 20 attach the upper support member 12 to the lower support member 26 while allowing both support members to pivot about the axis intersecting the hinges 20 without separating. Due to the semi-flexible nature of the clamp portion 28, however, the upper and lower support members are preferably not permanently attached and can be separated using a small amount of force should such separation become necessary, for example, to repair or replace a broken support member.

Of course, other forms of hinges can be employed with the disk propelling and retrieving apparatus 10 to achieve the same function of the mechanical hinges 20. The function of the hinges 20 is to permit the opening and closing of the upper and lower support members 12, 26 in order to capture the disk 16. For example, in an alternate preferred embodiment of the invention, the mechanical hinges 20 shown in FIGS. and 2 can be replaced by a living hinge in a manner generally known in the art. Other types of hinges are also contemplated as may be suitable depending upon the materials employed to manufacture the upper and lower support members 12, 26. Suitable equivalent structures that perform the function of the hinges 20 can include a tethered connection, welding, a threaded screw and bore, or even no interconnection where operation of the player's hand provides the function described above. In addition, the hinge can also be disposed at other locations around the periphery of the support members to serve its intended function.

The disk propelling and retrieving apparatus 10, as well as the aerodynamic flying disk 16, can be formed of any suitable material. In the preferred embodiment, the apparatus 10 and disk 16 are preferably manufactured from semi-rigid, hard plastics, such as high density polyethylene, polystyrene or polypropylene. To manufacture both items quickly and at low costs, the apparatus 10 and disk 16 are preferably injection-molded to the shapes shown in FIGS. 1–6.

As mentioned above, one or more finger loops 22 are preferably provided on the upper and lower support members. 12, 26 of the invention. Preferably, two such finger loops 22 are provided (FIG. 3); one finger loop 22 is coupled to the upper support member 12, and another finger loop 22 is coupled to the lower support member 26. A player thus inserts his or her thumb in the finger loop 22 attached to the upper support member 12, and his or her index or middle finger through the finger loop 22 attached to the lower support member 26. In this configuration, the player can comfortably grasp the disk propelling and retrieving apparatus 10 about the handle sections 14 provided on both the upper and lower support members 12, 26 and operate the support members to propel and retrieve the disk 16.

Figure 3:
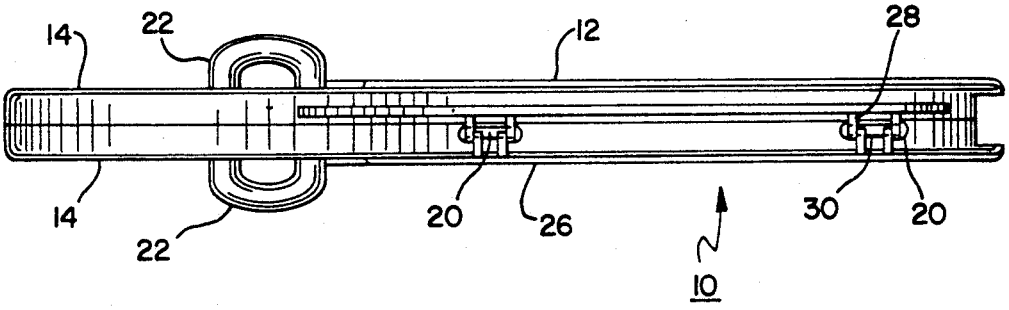
FIG. 3 is a side view taken along line 3—3 of FIG. 1 showing the presently preferred mechanical hinges connecting the upper and lower support members, and the finger retaining loops.
Figure 4:
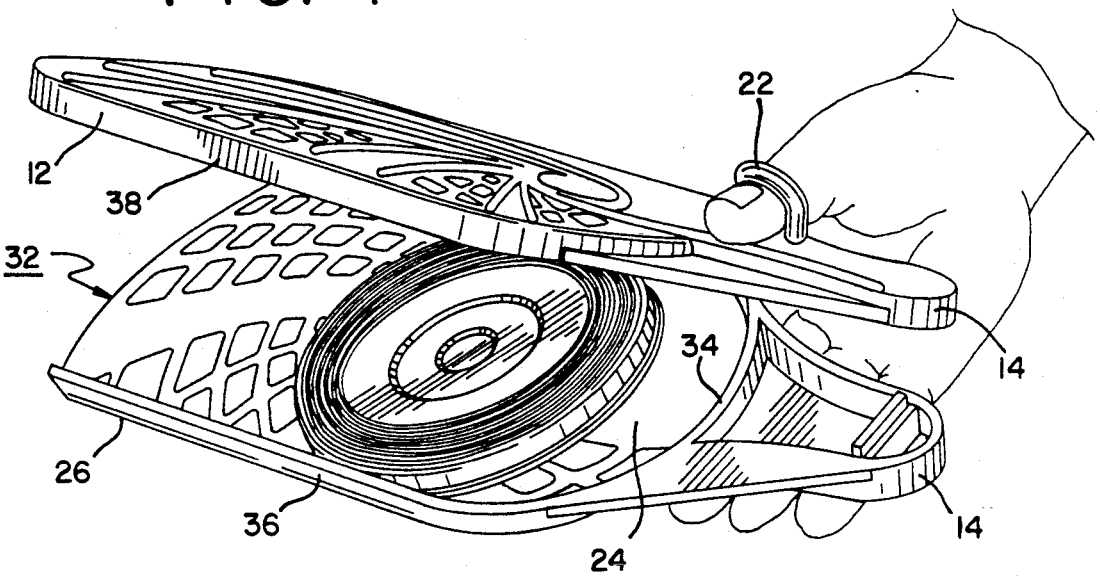
FIG. 4 is a perspective view of the apparatus shown in FIG. 1 containing a disk and opened to illustrate the cavity between the support members.

FIG. 4 shows the apparatus in use. As mentioned above, a player preferably grasps the apparatus around the handle sections 14 provided on both the upper and lower support members 12, 26 in the manner shown in FIG. 4. As presently preferred, the finger loops 22 are positioned on the upper and lower support members 12, 26 at an angle and orientation with respect to the handle section 14 to facilitate easy manipulation of the support members about the hinges 20 (FIG. 3). In a preferred embodiment of the invention, the finger loops 22 are also covered or coated, either partially or completely, with a soft impact-absorbing substance, such as rubber or latex tubing, to ensure the player's comfort and to provide increased control over the upper and lower support members 12, 26.

FIG. 4 also shows the aerodynamic flying disk 16 contained within the cavity 24 of the lower support member 26. As can be seen, the cavity 24 is approximately the width of the disk 16, and can be as long as desired to ensure proper disk propulsion. In the preferred embodiment, the upper and lower support members 12, 26 form opposing mirror halves of the cavity 24, such that when the support members are brought together, a cavity of sufficient height to retain the disk 16 is created. As such, the lower support member 26 includes a peripheral depending wall 36 projecting upwardly toward the upper support member 12 and extending around most of the periphery of the cavity 24 except for an aperture or open end 32 provided in the cavity 24. In similar fashion, the upper support member 12 likewise includes a peripheral depending wall 38 extending mostly around the cavity 24 except for the open end 32. Both the upper and lower depending walls 36, 38 also extend inwardly approximately one-half the height of the disk 16 to form the opposite halves of the cavity 24. In an alternate embodiment, the upper or lower depending walls 36, 38 are preferably vertically scored along their length to provide additional friction to the walls 34, 36 to impart sufficient spin to the disk 16 as the disk 16 is propelled from the cavity 24.

The cavity 24 should also be at least sufficiently long to impart the necessary spinning motion to the aerodynamic flying disk 16 to ensure the disk's flight and trajectory. To achieve such flight, the disk 16 is propelled out of the open end 32 of the cavity 24 by applying centrifugal force through the handle section 14 of the apparatus 10. As shown in FIG. 4, this open end 32 is preferably located opposite the handle section 14 and, of course, is wide enough to allow movement of the disk 16 out of the cavity.

Figure 5:
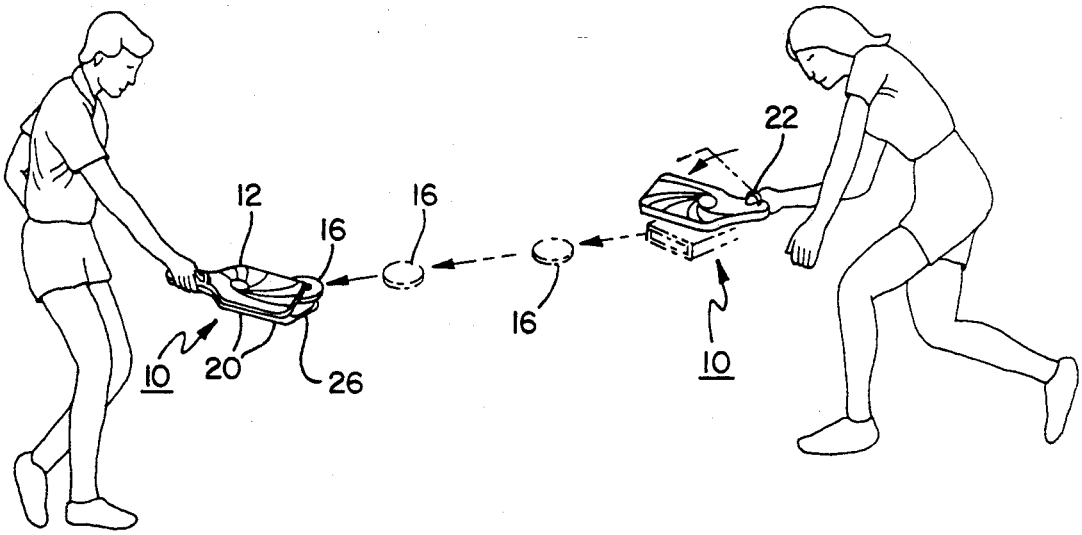
FIG. 5 illustrates the use of the device of FIGS. 1–4 by two players to propel and retrieve a disk.

As presently contemplated, the disk propelling and retrieving apparatus 10 can be employed by one or more players to throw and catch the disk 16, as illustrated in FIG. 5. The disk 16 is inserted within the cavity 24 of a disk propelling and retrieving apparatus 10 to start the play of the game. Thereafter, a first player closes the upper and lower support members 12, 26 around the disk 16, and moves the apparatus 10 with a wrist-snapping motion to propel the disk from within the cavity 24 out through the open end 32. As represented by the bi-directional arrow in FIG. 5, a player can employ either a forward or back-handed motion to apply centrifugal force to the apparatus 10, thus imparting the desired circular spin to the disk 16. As the disk 16 rotates along the depending walls 36, 38 which are maintained in contact when the support members 12, 26 are held together, the friction of the walls 34, 36 causes the disk 16 to spin at a velocity sufficient to achieve and maintain flight.

A second player may then retrieve the disk, after it has been propelled by the first player, in the manner illustrated in FIG. 5. The second player manipulates the upper support member 12, by using his or her thumb in combination with the finger loop 22, to pivot the upper support member 12 about the hinges 20. Once open, the upper support member 12 operates to deflect the disk 16 into the cavity 24 so that the second player can lower the upper support member 12 to retain the aerodynamic flying disk 16 within the cavity 24. Thus, the disk 16 can enter the cavity 24 (FIG. 4) in a position ready for future propulsion, or the disk 16 can be trapped and held between both support members 12, 26. If the disk 16 is trapped between the upper and lower support members 12, 26 as it is received by the second player, the second player may need to move the disk 16 by hand into the cavity 24 before propelling the disk 16 back toward the first player. Once the aerodynamic flying disk 16 is within the cavity 24 of the second player's disk propelling and retrieving apparatus 10, these steps are repeated so that the second player propels the aerodynamic flying disk 16 in the direction of the first player.

Figure 6:
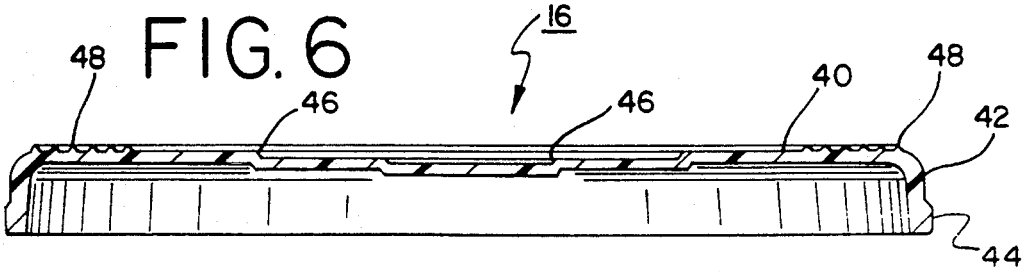
FIG. 6 shows a cross-sectional view of a presently preferred embodiment of an aerodynamic flying disk suitable for use with the device of FIGS. 1–4.

Although the aerodynamic flying disk 16 can take many shapes, sizes and configurations, one presently preferred embodiment of the aerodynamic flying disk 16 is shown in cross-section in FIG. 6. As illustrated, the aerodynamic flying disk 16 is concave and preferably includes a substantially flat, circular upper surface 40. A depending wall 42 is positioned along the periphery of the upper surface 40 to project downwardly from the upper surface 40, thereby creating the concave structure of the disk 16. The disk 16 should be sized to fit within the cavity 24. In the preferred embodiment, the diameter of the aerodynamic flying disk 16 is approximately 6 inches, and the height of the depending wall 42 is approximately 9/16ths of an inch.

The aerodynamic flying disk 16 shown in FIG. 6 also includes an annular reinforcing band 44 disposed along the outer, lower edge of the depending wall 42. The reinforcing band 44 is preferably made of the same material as the disk 16 and is integral therewith. The band 44 is thus employed to reinforce the depending wall 42 and protect the depending wall 42 from damage or breaking. As further shown in FIG. 6, the disk 16 can also include a plurality of steps 46 and ridges 48 to increase the disk's aerodynamic qualities as well as for aesthetic or cosmetic purposes.

As described above, the apparatus 10 assists the player in retrieving the disk as it flies through the air, and in propelling the disk to one or more players. The apparatus 10 thus enables a player to learn the proper form for manually throwing the aerodynamic flying disk by hand, and also protects a player from injury while attempting to catch and throw the aerodynamic flying disk.

It is to be understood that a wide range of changes and modifications to the embodiments described above will be apparent to those skilled in the art, and are contemplated. It is, therefore, intended that the foregoing detailed description be regarded as illustrative rather than limiting, and that it be understood that it is the following claims, including all equivalents, that are intended to define the spirit and scope of this invention.

I claim:

1. A game device comprising:
a lower support member;
an upper support member hingedly coupled to the lower support member and operative to pivot from an open position, where the upper and lower support members meet at the hinge and extend away from each other, to a closed position where the upper and lower support members are in contact and define a cavity sized to freely permit movement of a disk in the cavity, the cavity having an aperture disposed only at a first end of the cavity sized to permit propulsion of the disk from the cavity only through the aperture; and
a handle disposed at a second end of the cavity opposite the first end.

2. A game device for propelling and retrieving a disk thrown between players, comprising:
a lower support member;
an upper support member;
means for hingedly coupling the upper support member to the lower support member to pivot to a closed position where the upper and lower support members are in contact and define a cavity sized to freely permit movement of the disk in the cavity, the cavity having an aperture disposed only at a first end of the cavity sized to permit propulsion of the disk from the cavity only through the aperture; and
a handle disposed at a second end of the cavity opposite the first end.

3. A game device comprising:
a lower support member;
an upper support member hingedly coupled to the lower support member and operative to pivot to a closed position where the upper and lower support members are in substantial contact and define a cavity sized to freely permit movement of a disk in the cavity, the cavity having an aperture disposed only toward a first end of the cavity sized to permit propulsion of the disk from the cavity only through the aperture, and to an open position where the upper and lower support members meet at the hinge and define an opening for receiving the disk, the opening having a substantially V-shaped configuration and the opening being substantially wider than the height of the disk; and
a handle disposed at a second end of the cavity opposite the first end.

4. A disk propelling and retrieving apparatus comprising:
a concave circular disk;
a lower support member for supporting the disk;
a hinge coupled to the lower support member;
an upper support member coupled to the hinge, the upper support member operative to pivot to a closed position where the upper and lower support members are in contact and define a cavity sized to freely permit movement of the disk in the cavity, the cavity having an aperture disposed only toward a first end of the cavity sized to permit propulsion of the disk from the cavity only through the aperture, and to an open position where the upper and lower support members only contact at the hinge and define an opening to receive the disk, the opening being substantially wider than the height of the disk; and
a handle disposed at a second end of the cavity opposite the first end.

5. The disk propelling and retrieving apparatus defined in claim 4, further comprising means disposed on the upper support member for opening and closing the upper support member.

6. The disk propelling and retrieving apparatus defined in claim 5, wherein the means for opening and closing the upper support member comprises means for retaining a player's thumb.

7. The disk propelling and retrieving apparatus defined in claim 5, wherein the means for opening and closing the upper support member comprises means for retaining a player's finger.

8. The disk propelling and retrieving apparatus defined in claim 4, wherein the hinge comprises a mechanical hinge.

9. The disk propelling and retrieving apparatus defined in claim 4, wherein the hinge comprises a living hinge.

10. The disk propelling and retrieving apparatus defined in claim 4, wherein at least the lower support member further comprises a peripheral depending wall, the peripheral depending wall extending substantially around the perimeter of the cavity to meet the upper support member.

11. The disk propelling and retrieving apparatus defined in claim 10, further comprising means for increasing the contact friction between the peripheral depending wall and the disk.

12. A method for propelling and retrieving a disk comprising the steps of:
placing the disk on a lower support member sized to receive the disk;
pivoting an upper support member hingedly coupled to the lower support member from an open position, where the upper and lower support members meet at the hinge coupling and extend away from each other, to a closed position where the upper support member is in juxtaposed contact with the lower support member and defines a cavity of sufficient size to freely permit movement of the disk in the cavity, the cavity having an aperture disposed only toward a first end of the cavity sized to permit propulsion of the disk from the cavity only through the aperture;
propelling the disk from within the cavity through the aperture while the upper and lower support members are in the closed position; and
retrieving the disk by pivoting the upper support member from the closed position to the open position and receiving the disk between the upper and lower support members.

13. The method for propelling and retrieving a disk defined in claim 12, further comprising the step of pivoting the upper support member to the closed position once the disk has been retrieved.

14. The method for propelling and retrieving a disk defined in claim 12, wherein the disk is deflected by the upper support member in the open position to be received by the lower support member.

15. The method for propelling and retrieving a disk defined in claim 12, wherein the step of propelling comprises applying a centrifugal force through at least the lower support member to the disk to cause the disk to fly through the air.

16. The method for propelling and retrieving a disk defined in claim 15, wherein the step of applying a centrifugal force further comprises imparting a circular spin to the disk as the disk moves in the cavity and through the aperture.

17. The method for propelling and retrieving a disk defined in claim 16, wherein at least the lower support member further comprises a peripheral depending wall and the step of imparting a circular spin to the disk comprises the step of increasing the contact friction between the peripheral depending wall and the disk.

18. A method for propelling and retrieving a disk between two players, comprising the steps of:

placing the disk within a first disk propelling and retrieving apparatus held by a first player and defined by a first upper support member hingedly coupled to a first lower support member, the first upper and lower support members pivotable between an open position where the first upper and lower support members contact at the hinge coupling and a closed position where the first upper and lower support members are in juxtaposed contact and define a first cavity sized to freely permit movement of the disk in the cavity, the first cavity having a first aperture disposed only at a first end of the first cavity sized to permit propulsion of the disk from the first cavity only through the first aperture;

propelling the disk from within the first cavity through the first aperture;

retrieving the disk propelled by the first player within a second disk propelling and retrieving apparatus held by a second player and defined by a second upper support member hingedly coupled to a second lower support member by pivoting the second upper support member from an open position where the second upper and lower support members contact at the hinge coupling to a closed position where the second upper and lower support members are in juxtaposed contact and define a second cavity sized to freely permit movement of the disk therein, the second cavity operative to receive the disk and having a second aperture disposed only at a first end of the second cavity; and propelling the disk from within the second cavity only through the second aperture.

19. A method for propelling and retrieving a disk comprising the steps of:

placing the disk on a lower support member sized to receive the disk;

pivoting an upper support member hingedly coupled to the lower support member from an open position, where the upper and lower support members meet at the hinge coupling, to a closed position in juxtaposed contact with the lower support member and defining a cavity of sufficient size to freely permit movement of the disk in the cavity, the cavity having an aperture disposed only toward a first end of the cavity sized to permit propulsion of the disk from the cavity only through the aperture;

propelling the disk from within the cavity through the aperture; and retrieving the disk by pivoting the upper support member from the closed position contacting the lower support member to the open position, the open position defining an opening for receiving the disk, the opening having a substantially V-shaped configuration and operative to open substantially wider than the height of the disk.

* * * * *

UNITED STATES PATENT AND TRADEMARK OFFICE

CERTIFICATE OF CORRECTION

PATENT NO. : 5,232,226

DATED : August 3, 1993

INVENTOR(S) : David A. Glickson

It is certified that error appears in the above-indentified patent and that said Letters Patent is hereby corrected as shown below:

Column 4, line 34, after "FIGS." please insert --1 --.

Signed and Sealed this

Fifth Day of July, 1994

*Attest:*

Bruce Lehman

BRUCE LEHMAN

*Attesting Officer*

*Commissioner of Patents and Trademarks*